United States Patent [19]

Hesch et al.

[11] Patent Number: 4,573,843

[45] Date of Patent: Mar. 4, 1986

[54] HITCH MOUNTING MEANS

[75] Inventors: Harold E. Hesch, St. John, Ind.; George S. McNally, So. Holland, Ill.

[73] Assignee: Pullman Standard, Chicago, Ill.

[21] Appl. No.: 507,143

[22] Filed: Jun. 23, 1983

[51] Int. Cl.[4] ..... B60P 3/07

[52] U.S. Cl. ..... 410/58; 410/56

[58] Field of Search ..... 410/4, 7, 9, 19, 22, 410/24, 26, 56, 58, 77, 57, 59-65; 248/500, 514, 536; 403/68, 79, 157, 4, 85, 103

[56] References Cited

U.S. PATENT DOCUMENTS 290,889 12/1883 Kellogg ..... 403/85

3,003,434 10/1961 Clejan ..... 410/61 X 3,358,955 12/1967 Wille et al. ..... 410/64

3,653,621 4/1972 Ferris et al. ..... 410/59 X

*Primary Examiner*—Robert B. Reeves

*Assistant Examiner*—David F. Hubbuch

*Attorney, Agent, or Firm*—Richard J. Myers & Assoc.

[57] ABSTRACT

Pivot mounts for enabling pivotal attachment of support struts of a fifth wheel hitch assembly to the deck of a raiway car are provided with a fabricated inverted U shaped torque box or beam fixed transversely between upright pivot mount plates of the center sill mounted hitch on the railway car for structural strength and rigidity. Due to the torque box the mount is sufficiently rigid to preclude the need to attach the pivot mount to the inside of the box sill of a railway car.

11 Claims, 6 Drawing Figures

FIG. 1
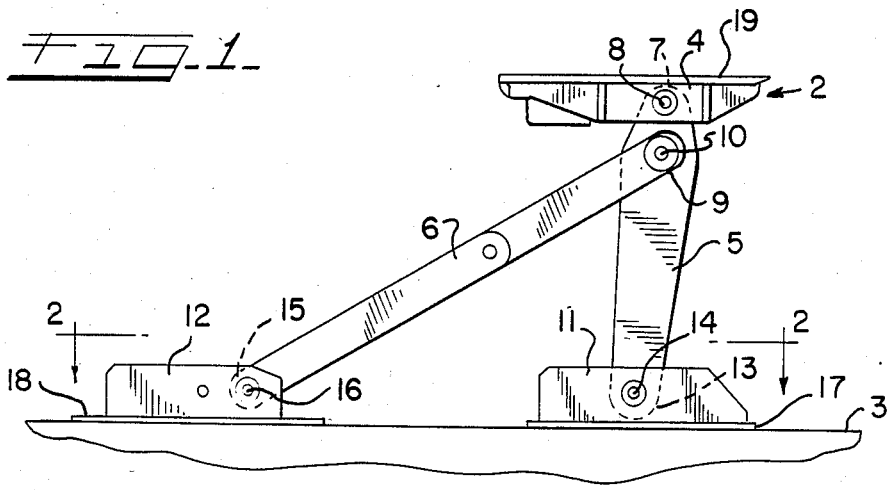
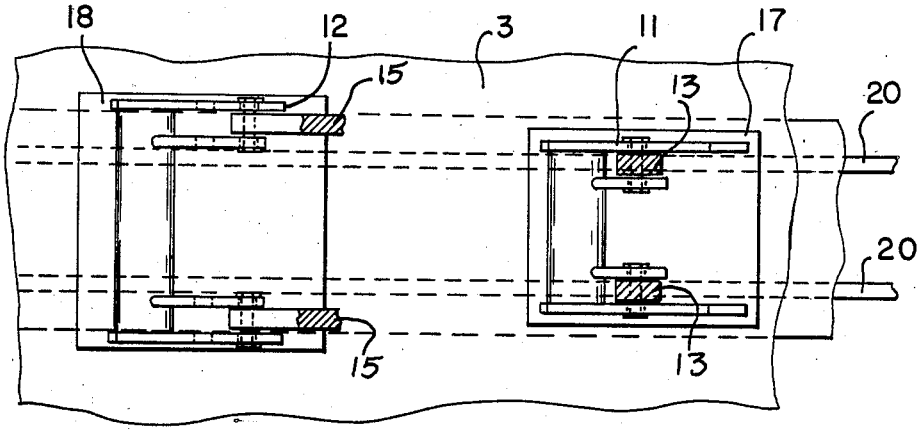
FIG. 2
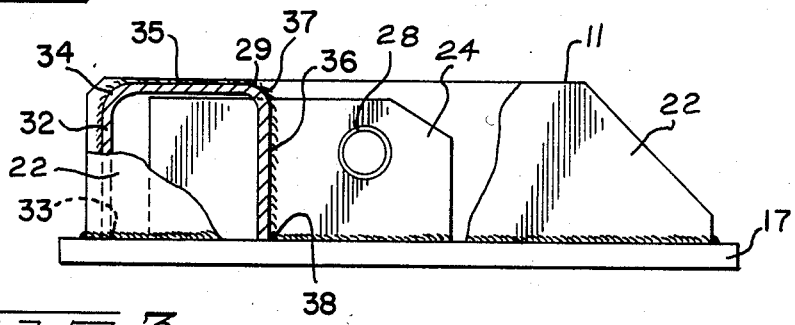
FIG. 3

HITCH MOUNTING MEANS

BACKGROUND OF THE INVENTION

1. Field of the Invention

This invention relates to collapsible trailer hitches of the type used to retain highway cargo trailers on railway cars or ship decks. The invention specifically relates to pivot mounts for attaching the collapsible hitch to a deck or support surface.

2. Description of the Prior Art

Fifth wheel hitch assemblies used to support cargo trailers hauled on railway cars maintain the trailers positioned on the cars by attachment to the kingpin of the trailer. These support assemblies are collapsible to enable the assembly to retract away from the trailer onto the deck of the railway car so a tractor equipped with a fifth wheel can engage the kingpin and remove the trailer from the railway car. Due to the need for collapsibility these support assemblies are pivotally mounted to the deck or support surface of the railway car by pivot mounts rigidly attached to the railway car. These mounts are subjected to severe force loadings, particularly during abrupt accelerations and decelerations of the railway car while the support assembly is supporting a heavily laden cargo trailer. Past efforts to strengthen the pivot mountings for the support struts have included the need to rigidly attach gussets from the inner sides of the box sill members of the railway car to the pivot mountings as well as to the outside of the box sill members. The need to attach gussets to the inner surfaces of the box sill members and the pivot mountings entails undesirably complicated and costly construction to enable the pivot mountings to transfer strut loadings from the support struts through the pivot mounts to the box sill members without damage to, or failure of, the pivot mountings.

U.S. Pat. No. 3,653,621 shows an angle shaped member which serves as a connective member between the components of a pivot bracket or mount.

SUMMARY OF THE INVENTION

In the field of flat railroad car mounted hitches, a principal purpose of the invention is to provide a reinforcement in the form of an inverted U shaped beam between the pivot mounts of the hitch, whereby the box rigidly attaches the lugs, end members, and base member of a hitch pivot mount structure together.

A further object is to provide a three walled torque box or beam in position and configure it to engage and rigidly maintain components of a strut pivot mount for the fifth wheel support assembly of a railway car in a relationship sufficiently strong to enable the pivot mount to be rigidly affixed to the center sill of a railway car by placement of gussets or the like only between the external or outside surfaces of the box sill members and the pivot mounts or by rigidly attaching the pivot mount directly to the deck of the car without the need to form a direct connection between the box sill members and the pivot mount by going through the deck.

BRIEF DESCRIPTION OF THE DRAWINGS

FIG. 1 is an elevation view of a typical fifth wheel cargo trailer support assembly pivotally mounted on a railway car;

FIG. 2 is a top section view of FIG. 1 as indicated by the section line 2—2;

FIG. 3 is a partial cutaway side view of vertical strut pivot mount shown in FIGS. 1 and 2;

DETAILED DESCRIPTION OF THE INVENTION

Figure 4:
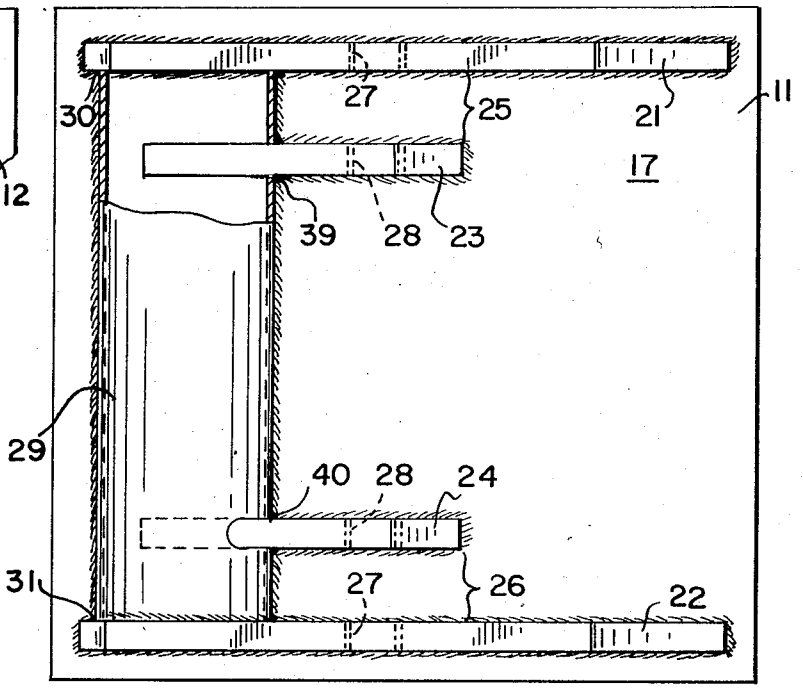
FIG. 4 is an enlarged partially cutaway view of the front or vertical strut pivot mount shown in FIG. 2.

FIG. 1 shows an elevation view of a typical collapsible cargo trailer fifth wheel hitch assembly 2 pivotally mounted on the deck or support surface 3 of a railway car (not shown). Assembly 2 is comprised of a fifth wheel 4, a front or vertical support strut 5 and a diagonal and collapsible rear support strut 6.

As shown, fifth wheel assembly 2 is pivotally attached adjacent an upper end 7 of support strut 5 by appropriate means such as a pivot pin 8.

An upper end 9 of rear or diagonal strut 6 is pivotally engaged with support strut 5 by a pivot pin 10.

Rigidly affixed to the deck 3 of the railway car is a front or vertical strut pivot mount assembly 11 and a rear or diagonal strut pivot mount assembly 12. Adjacent its lower end 13 strut 5 is pivotally engaged with front pivot mount 11 by pivot pin 14. Similarly, lower end 15 of diagonal strut 6 is pivotally engaged with rear pivot mount 12 by a pivot pin 16.

As shown, pivot mount assemblies 11 and 12 are constructed on a base means, such as support plates 17 and 18, respectively. However, as will be readily understood by those skilled in the art of cargo trailer transport by rail, the pivot mount base means may be the deck or top surface of the railway car.

Also, as will be readily understood by those skilled in the art of cargo trailer transport by rail, the top surface 19 of fifth wheel 4 is adapted to engage the underside support surface of a cargo trailer (not shown) and lockingly receive a kingpin (not shown) on the trailer to maintain the fifth wheel and trailer engaged. Diagonal strut 6 is collapsible intermediate pivot pins 10 and 16 to enable the fifth wheel 4 and vertical strut 5 to rotate about pivot pin 14 and collapse or retract onto surface 3. Typically, diagonal strut 6 is provided with resilient shock absorption means to dampen mechanical shock loads transferred from the railway car through the hitch to the trailer and its cargo.

FIG. 2 shows a top sectioned view of FIG. 1 in which the front mount 11 and rear mount 12 are shown mounted on base means or plates 17 and 18 and the plates are rigidly affixed to the deck 3 of a railway car. As shown, mounts 11 and 12 are preferably mounted astraddle the primary longitudinal support members of the railway car, such as members 20 which form the center sill of the railway car.

FIGS. 3 and 4 show an enlarged cutaway side view and a partial cutaway top view, respectively, of the structure of front or vertical strut pivot mount 11.

Referring to FIG. 4 pivot mount 11 is comprised of a first end member 21 and a second end member 22. As shown, end members 21 and 22 are positioned parallel to each other, spaced from each other and rigidly attached such as by welding, as indicated, to support plate 17.

A first lug member 23 and a second lug member 24 are positioned between end members 21 and 22. First lug member 23 is positioned adjacent, parallel to and in a spaced relationship from first end member 21 and second lug member 24 is positioned adjacent, parallel to and in a spaced relationship to second end member 22. The space 25 between first end member 21 and first lug member 23 and the space 26 between second end member 22 and second lug member 24 are provided to receive an end of a support strut, such as strut 5. As shown lug member 23 and 24 are rigidly affixed to plate 17 by appropriate means, such as welding, as indicated.

A pair of aligned pivot pin receiving openings or aperture means 27 and 28 are provided in each end member, lug member set to receive a pivot pin for pivotally connecting the strut legs of strut 5 to the pivot mount 11.

A three walled formed torque box or beam 29 is positioned transverse and substantially normal to said end members. Box 29, as shown, has first end 30 abutting against and rigidly affixed, such as by welding, to first end member 21 and a second end 31, abutting against and rigidly affixed to end member 22.

Referring to FIG. 3 it will be seen that box 29 is comprised of a first vertically oriented wall 32 having a lower terminal end 33 and an upper end 34 connected with a second horizontally oriented wall 35 and a third vertically oriented wall 36 having an upper end 37 connected with horizontal wall 35 and a lower terminal end 38. The lower terminal ends 33 and 38 of the vertical walls define an open side of box 29. Each of the lower ends of the vertical walls abut and are rigidly secured, such as by welding, to a rigid base means, such as plate 17 to form a torque box structure therewith.

As shown in FIGS. 3 and 4 two slots or openings 39 and 40 are provided in wall 36. Each slot 39 and 40 is aligned to receive a portion of a lug member 23 and 24, respectively. The lug members are rigidly secured to the edges defining the slots 39 and 40 whereby the components of pivot mount 11 are secured together as a strong and rigid assembly.

Figure 6:
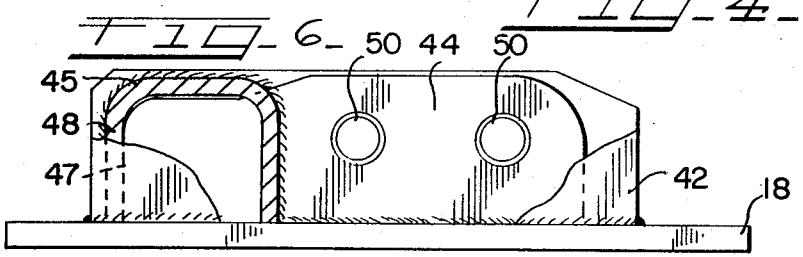
FIG. 6 is a partially cutaway side view of the pivot mount shown in FIG. 5.
Figure 5:
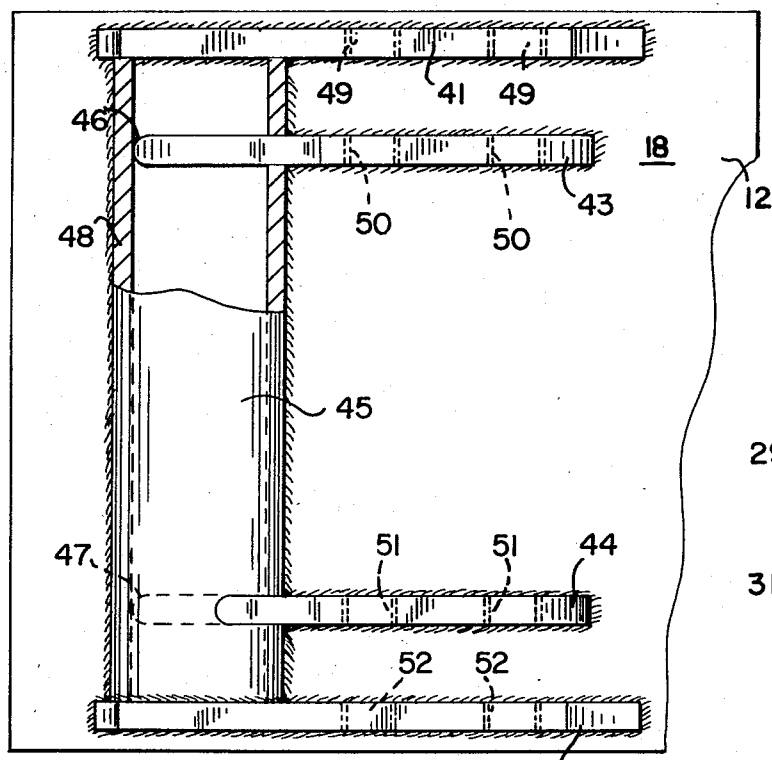
FIG. 5 is an enlarged partial cutaway view of the rear or diagonal strut pivot mount shown in FIG. 2.

FIGS. 5 and 6 show an enlarged partially cutaway top view and side view, respectively, of rear or diagonal strut pivot mount 12.

As shown, pivot mount 12 is similar in structure to pivot mount 11.

Pivot mount 12 has two end members 41 and 42, two lug members 43 and 44 and a torque box or beam 45 connected to the end and lug members substantially as described above for pivot mount 11.

Two differences between pivot mount 11 and pivot mount 12 are that the terminal ends 46 and 47 of lug members 43 and 44, respectively, abut against the first vertical wall 48 of beam 45 and each of the end member, lug member sets 41, 43 and 42, 44 are provided with two sets 49, 50 and 51, 52 of aligned pivot pin receiving openings. The provision of two sets of pivot pin openings enable the lower end 15 of diagonal strut 5 to be selectively positioned to receive two types of trailers having different dimensions between the kingpin and the front of the trailer.

What is claimed is:

1. A pivot mount for pivotally attaching an end of a fifth wheel support strut to a railway car, said mount comprising:

rigid base means;

a pair of end members spaced from each other and rigidly affixed to said base means;

a pair of lug members rigidly affixed to said base means, said pair of lug members being positioned between said end members and said lug members being spaced from each other and from said end members;

pivot means for pivotally attaching a support strut means to each of said end members and to a respective adjacent lug member spaced from each said end member; and a support beam having:

a first wall portion attached to the base means and extending upwardly therefrom and being disposed transversely with respect to the lug and end members, the first wall portion having an upper end;

a second wall portion connected to the upper end of the first wall portion and extending transversely and rearwardly therefrom, the second wall portion having a rearward end; and a third wall portion connected to the rearward end of the second wall portion and extending transversely and downward therefrom, the third wall portion having a lower end attached to the base means, whereby the support beam forms a torque box structure with the base means, said torque box structure being rigidly affixed to each of said end members and each of said lug members for rigidifying said pivot mount and for receiving from the lug members and the end members forces received from the strut and for transmitting those forces to the base means, each of said lug members being rigidly affixed to one of said wall portions of said support beam and being supportingly engaged by another of said wall portions of said beam.

2. The invention as defined in claim 1 in which each of said end members being rigidly affixed to each of said three wall portions of said support beam.

3. The invention as defined in claim 1 in which said pivot means is a pair of aligned aperture means for receiving a pivot pin in each end member and an adjacent lug member.

4. The invention as defined in claim 1 in which said pivot means is two sets of pairs of aligned openings for receiving a pivot pin in each end member and an adjacent lug member for pivotally attaching a strut member to said pivot mount in two different positions.

5. The invention as defined in claim 1 in which said base means includes a rigid mounting plate connected to the end members, the lug members, and the support beam.

6. The invention as defined in claim 1 in which said base means includes a deck surface means on the railway car, the deck surface means being connected to the end members, the lug members and the support beam.

7. The invention according to claim 1 and the first wall portion having openings therein and the lug members extending through the openings into the torque box structure.

8. The invention according to claim 7 and the lug members being connected with the three wall portions of the torque box structure.

9. A pivot mount for pivotally attaching an end of a fifth wheel support strut to a railway car, said mount comprising:

rigid base means;

a first end member and a second end member, each of said end members extending longitudinally and being spaced from each other and rigidly affixed to said base means;

a first lug member and a second lug member, each of said lug members being between said first end member and said second end member, said first lug member being positioned adjacent to said first end member in a spaced relationship from said first end member and rigidly secured to said base means and said second lug member being positioned adjacent to said second end member in a spaced relationship from said second end member and rigidly affixed to said base means;

the first end member and the first lug member having a first pair of aligned pivot pin receiving openings for pivotally engaging a strut member to said first end member and said first lug member;

the second end member and the second lug member having a second pair of aligned pivot pin receiving openings for pivotally engaging a strut member to said second end member and said second lug member; and a support beam having a first side wall, a second side wall and a third side wall and an open side, said support beam being positioned transverse and substantially normal to said end members, said support beam being rigidly affixed to said first and second end members and said open side being rigidly affixed to said base means, the support beam forming a torque box structure with the base means, and each of said lug members being rigidly affixed to said support beam whereby said torque box structure serves to rigidly maintain said end members and said lug members in a fixed relationship during imposition of high force loads imposed upon said pivot pin openings and to transfer said loads to the base means, each of said lug members being rigidly affixed to said third wall of said torque box structure and being supportingly engaged by said first wall.

10. The invention as defined in claim 9 in which said first wall and said third wall of said torque box structure are substantially perpendicular to said base means and said second wall is substantially perpendicular to said first wall and said third wall and parallel to said base means.

11. The invention as defined in claim 9 in which each of said lug members, being rigidly affixed to said torque box structure and supportingly engaged by said first wall.

* * * * *